United States Patent [19]

de Lanauze

[11] 4,012,978

[45] Mar. 22, 1977

[54] DIE CUTTING RULE

[76] Inventor: Jacques de Lanauze, 6421 Goncourt Ave., Ville d'Anjou, Quebec H1K 3X7, Canada

[22] Filed: Sept. 15, 1975

[21] Appl. No.: 613,560

[52] U.S. Cl. ..... 83/669; 76/107 C; 83/698

[51] Int. Cl.[2] ..... B26F 1/38

[58] Field of Search ..... 83/669, 698; 76/107 C

[56] References Cited

UNITED STATES PATENTS

| | | | |
|---|---|---|---|
| 1,327,652 | 1/1920 | Braden | 76/107 C |
| 1,861,456 | 6/1932 | Shaw et al. | 76/107 C X |
| 3,280,682 | 10/1966 | Sauer | 83/669 X |
| 3,335,628 | 8/1967 | Simms et al. | 76/107 C X |
| 3,835,746 | 9/1974 | Young, Jr. et al. | 83/669 X |

*Primary Examiner*—Frank T. Yost
*Attorney, Agent, or Firm*—Cushman, Darby & Cushman

[57] ABSTRACT

A cutting rule for use in a rotary die cutter is made up of a plurality of segments. Each segment has a notched marginal side edge whereby it interlocks with an adjacent segment.

1 Claim, 4 Drawing Figures

DIE CUTTING RULE

This invention relates in general to the cutting art and in particular to cutting rules or blades which are used on cylinders in rotary die stamping machines.

Rotary die cutting machines are used to cut corrugated paperboard, cardboard or the like to form blanks for boxes and containers. Cutting rules are mounted on rotary cylinders in patterns corresponding to the desired blank configuration and the blank material is passed between the nip of the cutting cylinder, mounting the cutting rules, and an opposed cushion cylinder. Blanks are thereby severed from the sheet material.

Presently used cutting rules have numerous deficiences, among them being the tendency to crack under tension, especially rules of substantial length. When this occurs, expensive down-time results while an inoperative rule is being replaced.

The present invention provides a rule construction which reduces the frequency of failure and which provides advanced pattern layout and ease of replacement. In accordance with a broad aspect of the invention, a cutting is segmented and each segment is adapted for interconnection with with other like segments which, together, form a cutting rule for mounting in a rotary die cutter. Each rule segment comprises a body portion having a lower section for insertion in a slot in the rotary die cutter and an integral upper section having cutting or perforating teeth thereon. The body portion has marginal side edges at least one of which has a notch therein whereby the notched side edge presents the lower section of the segment being offset with respect to the upper section on the notched side. The notch is adapted to engage a mating notch on an adjacent rule segment.

The invention is illustrated by way of example in the accompanying drawings in which.

The term "cutting teeth" as used in this disclosure refers to teeth on the rules of either the cutting or perforating type.

Figure 1:
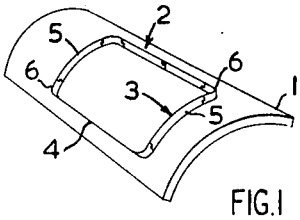
FIG. 1 is a perspective view of a curved die board incorporating a pattern of cutting rules.

Referring to FIG. 1 a curved die board I has been slotted and provided with a pattern 2 of cutting rules 3 made up of various configurations of rule segments. For example, the pattern comprises straights 4, contoured straights 5 and curved corners 6, all of the segments being connected together in a manner subsequently described.

Figure 2:
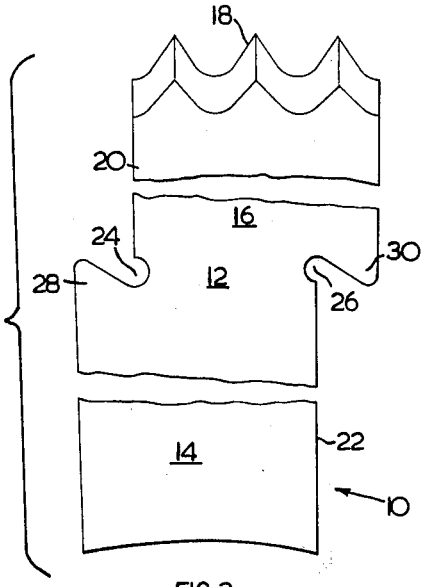
FIG. 2 is an elevation view of one form of rule segment.

As shown in FIG. 2 a die rule segment 10 of the straight or contoured straight type is of flat, planar form having a body portion 12 with a lower section 14 and an upper section 16. The lower section 14 is adapted for insertion into a slot provided in a curved die board such as is shown in FIG. 1. The upper section 16 is provided on its top edge with a plurality of cutting teeth 18 of a desired configuration.

The body 12 of the segment has marginal side edges 20 and 22 each of which has a notch 24 and 26 respectively. The notches are so formed that the upper section 16 of the segment is offset with respect to the lower section 14 as shown in FIG. 2. It will also be noted that the notches 24 and 26 are so angled that the marginal side edge 20, on the lower section 14 has an upwardly directed lip 28 while the marginal side edge 22 on the upper section 16 has a downwardly directed lip 30.

Figure 4:
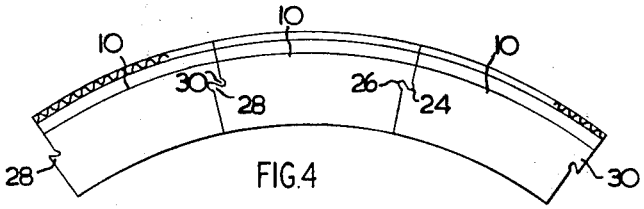
FIG. 4 is an elevation view of a portion of a cutting rule.

Turning to FIG. 4, a plurality of segments 10 are connected together by way of the mating of the lips 30 engaging the adjacent lip 28 and notch 24 of an adjacent segment in the rule.

Figure 3:
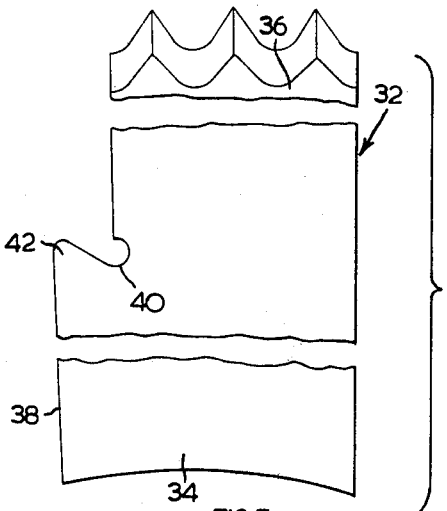
FIG. 3 is a view similar to FIG. 2 but showing another form of rule segment.

If the rule pattern requires it, single notch segments can be provided as shown in FIG. 3. Such a segment 32 has its lower section 34 offset with respect to the upper section 36 on one side only inasmuch as only one marginal side edge 38 is provided with a notch 40 and lip 42, the other side edge 44 being uninterrupted.

It will be appreciated that by virtue of the notches and lips, the individual segments can easily be made up into rule patterns and can be quickly replaced, if required, because of wear or damage.

The embodiments of the invention in which an exclusive property or privilege is claimed are defined as follows:

1. A cutting rule segment adapted for interconnection with other like segments to form a cutting rule for mounting in a rotary die cutter, said rule segment comprising a body portion having a lower section for insertion in a slot in the rotary die cutter and an integral upper section having cutting teeth thereon;

marginal side edges on the body portion; a notch in each of said marginal side edges of the body portion whereby the notched marginal side edges present the lower section of the segment being offset with respect to the upper section on the notches sides;

the notch on one marginal side edge comprising an upwardly directed lip and a downwardly directed socket to engage and receive a downwardly directed lip and upwardly directed socket on the other marginal side edge of an adjacent segment whereby the notches on each segment engage and interlock with mating notches on adjacent rule segments to provide a substantially rigid unitary cutting rule.

* * * * *